US006784852B2

(12) United States Patent
Merrill

(10) Patent No.: US 6,784,852 B2
(45) Date of Patent: Aug. 31, 2004

(54) MULTIPORT SERIAL FEED DEVICE

(75) Inventor: Jeffrey C. Merrill, Manlius, NY (US)

(73) Assignee: Anaren Microwave, Inc., East Syracuse, NY (US)

( * ) Notice: Subject to any disclaimer, the term of this patent is extended or adjusted under 35 U.S.C. 154(b) by 0 days.

(21) Appl. No.: 10/272,324

(22) Filed: Oct. 16, 2002

(65) Prior Publication Data

US 2004/0017326 A1 Jan. 29, 2004

Related U.S. Application Data

(63) Continuation of application No. 10/207,582, filed on Jul. 29, 2002.

(51) Int. Cl.[7] ..... H01Q 1/36
(52) U.S. Cl. ..... 343/895; 343/853
(58) Field of Search ..... 343/895, 853, 343/860, 850; 333/124, 136, 25, 26; H01Q 1/36

(56) References Cited

U.S. PATENT DOCUMENTS 5,138,331 A * 8/1992 Josypenko ..... 343/895
5,635,945 A * 6/1997 McConnell et al. ..... 343/895
5,828,348 A * 10/1998 Tassoudji et al. ..... 343/895
6,421,028 B1 * 7/2002 Ohgren et al. ..... 343/895

* cited by examiner

*Primary Examiner*—Hoanganh Le
(74) *Attorney, Agent, or Firm*—Robert J. Sinnema; Bond, Schoeneck & King, PLLC

(57) ABSTRACT

A circuit dividing and/or combining signals that has an input port for receiving a first signal, a first transmission line connected at one end to the input port, and a first connection point. The first connection point is connected to another end of the first transmission line. The first connection point provides a path to a first output port. A plurality of additional transmission lines, connection points and output ports is connected in sequence. Each transmission line is connected at one end to the (N−1)th connection point. A N connection point is connected to another end of the N transmission line. The N connection point provides a path to a N output port. The circuit provides equal amplitude at each of the anntena ports and further provides 90° phase progression between each pair of adjacent output ports.

3 Claims, 3 Drawing Sheets

MULTIPORT SERIAL FEED DEVICE

FIELD OF THE INVENTION

This application is a continuation of application Ser. No. 10/207,582, filed Jul. 29, 2002. The present invention relates to multiport serial feed systems used in electronic circuits.

BACKGROUND OF THE INVENTION

Modem communication systems employ transceivers that are housed in satellites that orbit the earth. These systems include television broadcasting, radio broadcasting, telephone and wireless internet. These types of systems require a ground-based receiver/transceiver, or in some specialized instances, an aircraft based receiver/transceiver. For example, these systems may be in the form of a handheld device, a radio mounted in an automobile or a system in a home or business building. Each system of this type requires an antenna to provide reception/transmission of radio waves to complete the communication link between the satellite and the ground-based equipment. The antenna of choice is often the quadrifilar helix due to the radiation pattern and polarization that it produces.

A quadrifilar helix antenna is composed of four equally spaced identical helices wound on a cylindrical surface. For transmitting, the helices are fed with signals equal in amplitude and 0, 90, 180, and 270 degrees in relative phase to produce circularly polarized electromagnetic radiation. In the prior art, the helices are typically fed microwave energy by circuits containing a quadrature coupler and/or by a balun.

There are prior art methods known that provide feed networks for a multifilar antenna. An example is U.S. Pat. No. 5,594,461 to O'Neill which discloses the use of first, second and third transmission lines that are arranged in a "Z" configuration. The first transmission line matches impedances between the first and second antenna elements and communicatively couples the second antenna element with a quarter wavelength phase shift of its signals to the first antenna element. The second transmission line matches impedances between the third and fourth antenna elements and communicatively couples the fourth antenna element with a quarter wavelength phase shift of its signals to the third antenna element. The third transmission line matches the resultant impedance of the coupled third and fourth antenna elements to the resultant impedance of the coupled first and second antenna elements and couples the third and fourth elements to the coupled first and second antenna elements with a half wavelength phase shift of the respectively coupled signals. A fourth transmission line matches the resultant impedance and couples the coupled first, second, third and fourth antenna elements to the load.

Another prior art example is U.S. Pat. No. 6,094,178 to Sanford which discloses a method of using a 90 degree hybrid coupler to split the signal into two paths with one path having a 0 degrees phase shift and the second path having a 180 degree phase shift. Each path leads to a balun that further splits the signal resulting in four paths that each have the desired phase.

Although the prior art methods obtain satisfactory performance parameters, they are not readily adaptable to feed other circuits which require a single input signal to be split into a plurality of output signals, each output signal having the same amplitude.

OBJECTS AND SUMMARY OF THE INVENTION

It is an object of the present invention to provide a multipart serial feed device.

It is another object of the present invention to provide a multipart serial feed device that is small in size.

It is another object of the present invention to provide a multipart serial feed device that is easy to manufacture.

It is another object of the present invention to provide a multipart serial feed device that is capable of being contained in a surface-mountable package.

These and other objects of the present invention are obtained by a multipart serial feed device that has an input port for receiving a first signal, a first transmission line connected at one end to the input port, and a first connection point. The first connection point is connected to another end of the first transmission line. The first connection point provides a path to a first output port. A second transmission line is connected at one end to the first connection point. A second connection point is connected to another end of the second transmission line. The second connection point provides a path to a second output port. A plurality of additional transmission lines may each be connected at one end to the previous connection point. Each additional transmission line is connected at its other end to an additional connection point. Each additional connection point provides a path to an additional output port. The circuit provides equal amplitude at each of the output ports and further provides equal phase progression of 90° between each adjacent output port.

DETAILED DESCRIPTION

When describing the operation of a passive linear antenna and feed network, reciprocity is understood to exist. This means that the combined antenna/feed network can be described as either a transmitter or receiver. The network is described generically and can be used for feeding any type of antenna, antenna array or other circuit that requires equal power splitting (or combining) with an equal phase progression between adjacent feed points. This document addresses the case where there is one input and four outputs (same as four inputs and one output), however, the analysis can be applied in circuits with 2 to n outputs.

Figure 1:
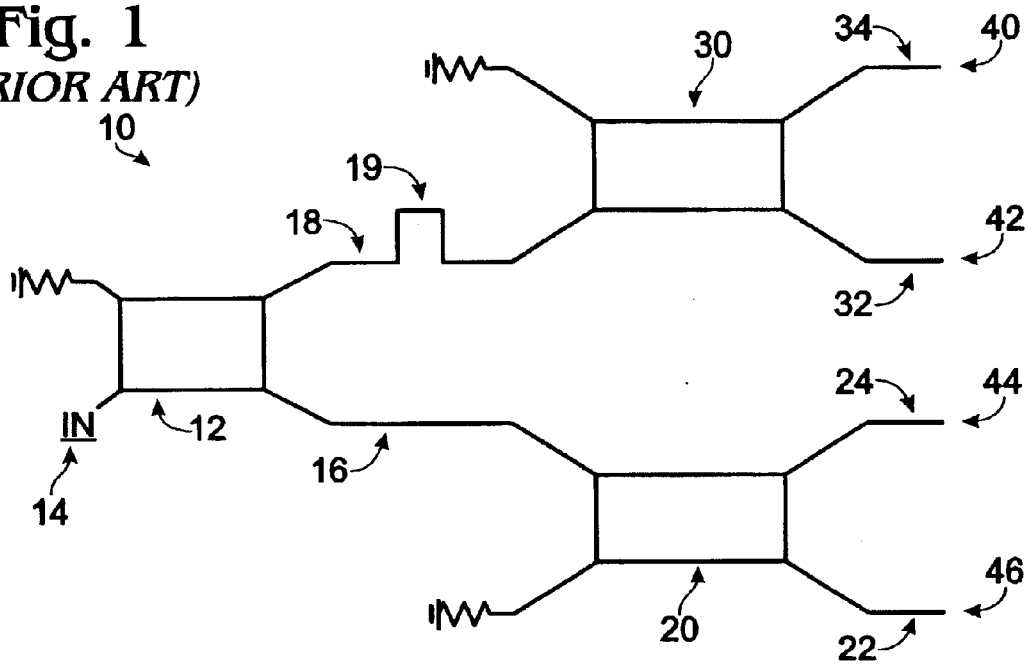
Fig. 1 (PRIOR ART)
FIG. 1 is a schematically simplified diagram of a representative prior art antenna feed network circuit.

A prior art circuit 10 is shown in FIG. 1. A first 3 dB hybrid coupler 12 splits the input signal 14 in half and also introduces a 0° phase shift in one path 16 and a 90° phase shift in the other path 18. The 0° path is connected directly to another 3 dB hybrid coupler 20. This second hybrid coupler 20 again splits the signal in half and introduces another 0° phase shift in one path 22 and a 90° phase shift in the other path 24. The 90° path 18 from the first 3 dB hybrid 12 is connected to apiece of transmission line 19 that is 90° long. The transmission line 19 is then connected to a third 3 dB hybrid coupler 30 which splits the signal in half and introduces another a 0° phase shift in one path 32 and a 90° phase shift in the other path 34. The resulting output signals 40, 42, 44, 46 are as required for radiation and are labeled in the FIG. 1.

This prior art circuit 10 is designed to provide phase rotation in one direction only. This is adequate for either forward or backward radiation. For narrowband operation, the circuit will function the same with or without the internal resistors when the antenna is well matched to the system impedance. There are a total of four quarter wavelengths of transmission line, plus interconnect length, required to construct this circuit. Three layers of dielectric material are required when the construction is in stripline and broadside coupled lines are used.

Figure 2:
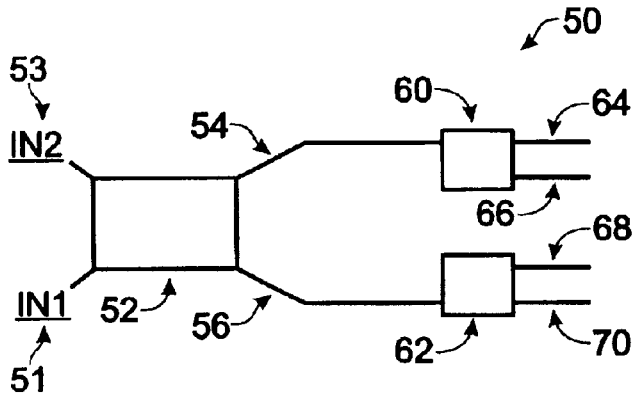
Fig. 2 (PRIOR ART)
FIG. 2 is a schematically simplified diagram of a representative prior art antenna feed network circuit.

Another prior art circuit 50 is shown in FIG. 2. A 3 dB hybrid coupler 52 splits the input signal 51, 53 in half and also introduces a 0° phase shift in one path 54 and a 90° phase shift in the other path 56. These paths are then connected to a second circuit 60 and a third circuit 62, typically transmission lines or baluns, that again split the signal in half. Each of these circuits 60, 62 introduce a 0° phase shift in one path 64, 68 and a 180° phase shift in the other path 66, 70. Unlike the circuit of FIG. 1, this circuit is capable of providing the desired phase progression in both directions. The two different progressions can be obtained by selecting either IN1 or IN2. Again, three layers of dielectric material arc required when the construction is in stripline and broadside coupled lines are used. The total electrical length will vary depending on how the balun circuit is implemented.

Figure 3:
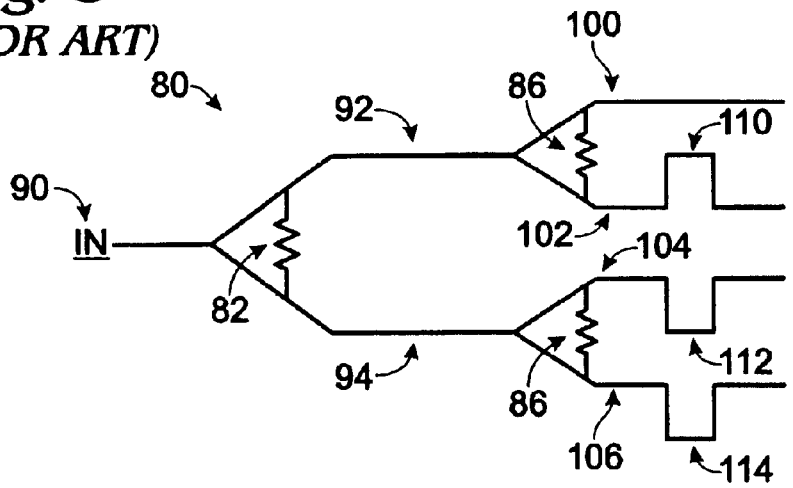
Fig. 3 (PRIOR ART)
FIG. 3 is a schematically simplified diagram of a representative prior art antenna feed network circuit.

Another prior art example of a circuit 80 is shown in FIG. 3. This circuit 80 uses Wilkinson power dividers 82, 84, 86 instead of 3 dB hybrid couplers. In this circuit 80, the input 90 is applied to the first power divider 82, which splits the signal in half with equal phase at the two outputs 92, 94. Each of these outputs is then applied to another power divider 84, 86, which again splits the signal in phase. At this point the signal has been equally split but all paths 100, 102, 104, 106 have the same phase. In order to achieve the proper phase progression, additional transmission line 110, 112, 114 is added to three of the paths (the electrical lengths are 90°, 180° and 270°).

This circuit 80 is designed to provide phase rotation in one direction only (this is adequate for either forward or backward radiation). Because the phase progression is introduced with transmission line, it is actually only ideal at one frequency. Therefore, this circuit will have good performance for narrow bandwidths only. The resistors could be removed from the circuit for such narrowband operation when the antenna is well matched. When realized in stripline, this circuit only requires two layers of dielectric material because no coupled lines are required.

Figure 4:
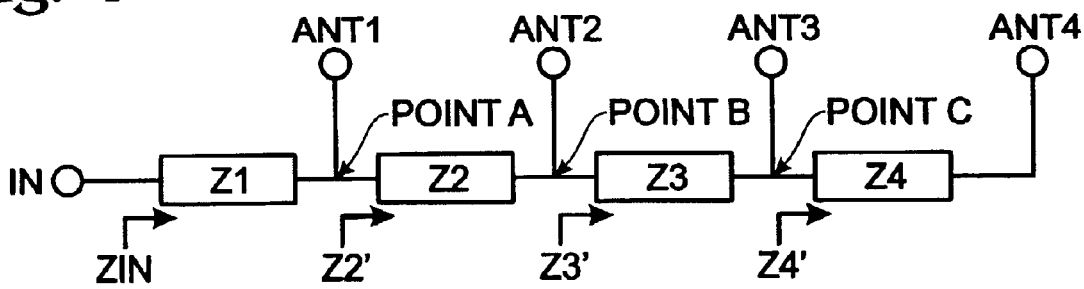
FIG. 4 is a schematically simplified diagram of one embodiment of the present invention antenna feed network circuit.

Now referring to FIG. 4, there is shown a schematic diagram depicting one embodiment of the present invention. The invention is made with four lengths of transmission line each having an electrical length of 90°. No coupling is required so the circuit can be achieved in stripline using only two layers of dielectric material or in microstrip using a single sheet of material. This circuit is intended for narrowband operation driving an impedance matched antenna and therefore no internal resistors are used and the 90° phase steps are achieved with transmission lines.

Referring to FIG. 4, a signal is applied to the input port (IN). The signal travels through the first section of transmission line Z1. At the end of Z1, point A, connection is made to ANT1 and to a second transmission line Z2. The impedance at point A is a parallel combination of ZANT1 and Z2' (Z2' is the impedance looking into Z2). Z2' is designed to be one third of ZANT1. This means the power division at point A will be 25% to ZANT1 and 75% into Z2.

The signal then travels through Z2 to point B. At point B connection is made to ANT2 and to a third transmission line Z3. The impedance at point B is a parallel combination of ZANT2 and Z3' (Z3' is the impedance looking into Z3). Z3' is designed to be one half of ZANT2. This means the power division at point B will be 33% to ZANT2 and 67% into Z3.

The signal then travels through Z3 to point C. At point C connection is made to ANT3 and to a fourth transmission line Z4. The impedance at point C is a parallel combination of ZANT3 and Z4' (Z4' is the impedance looking into Z4). Z4' is designed to be equal to ZANT3. This means the power division at point B will be 50% to ZANT3 and 50% into Z4. At the other end of Z4, the connection is made to ANT4. This network provides equal amplitude at each of the antenna ports and provides the desired phase progression because each of the transmission lines is 90 degrees long.

To analyze the circuit, first identify the known variables and the variables that need to be calculated. In general, the desired input impedance, Zin, will be known and the antenna port impedances will also be known. Assume that the antenna port impedances are equal (ZANT1=ZAN2=ZANT3=ZANT4) which will normally be the case and assign the new variable Zant. The four transmission lines Z1, Z2, Z3 and Z4 are all 90° long. The unknown variables Z1, Z2, Z3, Z4, Z2', Z3' and Z4' must be found.

$$Z4'=Zant \tag{1}$$

This will provide the 1:1 power split between ANT3 and Z4 at point C. This means that no impedance transformation can occur in Z4 and then:

$$Z4=Zant \tag{2}$$

Next, the parallel combination of Zant and Z4' (point C) will be transformed back through Z3 to point B. The result looking into Z3 is Z3'. The desired split ratio here is 2:1 so:

$$Z3'=Zant/2 \tag{3}$$

This means Z3 must transform Zant||Z4' to Zant/2. Z3 is a quarter wave transmission line transformer, which is a well documented circuit component with an impedance equal to the geometric mean of the impedances at each end of the line:

$$\begin{aligned} Z3 &= \sqrt{(Zant\|Z4')\times(Zant/2)} \\ &= \sqrt{(Zant\|Zant)\times(Zant/2)} \quad \text{(from(1))} \\ &= \sqrt{(Zant/2)\times(Zant/2)} \\ &= Zant/2 \end{aligned} \tag{4}$$

Next, the parallel combination of Zant and Z3' (point B) will be transformed back through Z2 to point A. The result looking into Z2 is Z2'. The desired split ratio here is 3:1 so:

$$Z2'=Zant/3 \tag{5}$$

This means Z2 must transform Zant||Z3' to Zant/3. Z2 is another quarter wave transmission line transformer:

$$Z2 = \sqrt{(Zant \| Z3') \times (Zant/3)} \quad (6)$$

$$= \sqrt{(Zant \| Zant/2) \times (Zant/3)} \quad \text{(from(3))}$$

$$= Zant/3$$

Finally, the parallel combination of Zant and Z2' (point A) will be transformed back through Z1 to the input. The impedance looking into the circuit is Zin, a user defined variable. This means Z1 must transform Zant||Z2' to Zin. Z1 is another quarter wave transmission line transformer:

$$Z1 = \sqrt{(Zant \| Z2') \times (Zin)} \quad (7)$$

$$= \sqrt{(Zant \| Zant/3) \times (Zin)} \quad \text{(from(5))}$$

$$= \sqrt{(Zant/4) \times (Zin)}$$

This circuit can be constructed using many different types of transmission lines such as coaxial, microstrip, co-planer waveguide, stripline, etc.

Figure 7:
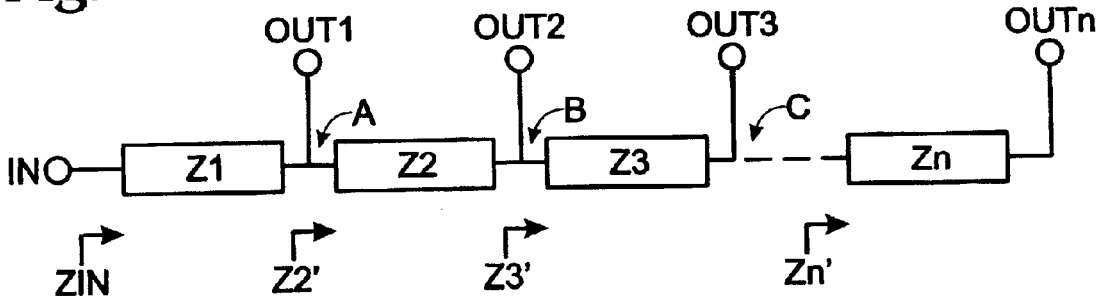
FIG. 7 is a schematically simplified diagram of another embodiment of the present invention.

The analysis of this circuit can also be extended to the general case of one input and "n" equal amplitude outputs with a 90° phase progression between each adjacent output. Referring to FIG. 7, there is shown a schematic diagram depicting another embodiment of the present invention. The invention is made n four lengths of transmission line each having an electrical length of 90°. No coupling is required so the circuit can be achieved in stripline using only two layers of dielectric material or in microstrip using a single sheet of material. This circuit is intended for feeding a circuit that requires signals of equal amplitude and 90° phase shift between adjacent signals.

Referring to FIG. 7, a signal is applied to the input port (IN). The signal travels through the first section of transmission line Z1. At the end of Z1, point A, connection is made to OUT1 and to a second transmission line Z2. The impedance at point A is a parallel combination of ZOUT and Z2' (Z2' is the impedance looking into Z2). Z2' is designed to be one third of ZOUT1. This means the power division at point A will be 25% to ZOUT1 and 75% into Z2.

The signal then travels through Z2 to point B. At point B connection is made to OUT2 and to a third transmission line Z3. The impedance at point B is a parallel combination of ZOUT2 and Z3' (Z3' is the impedance looking into Z3). Z3' is designed to be one half of ZOUT2. This means the power division at point B will be 33% to ZOUT2 and 67% into Z3.

The signal then travels through Z3 to point C. At point C connection is made to OUT3 and to a fourth transmission line Z4. The impedance at point C is a parallel combination of ZOUT3 and Z4' (Z4' is the impedance looking into Z4). Z4' is designed to be equal to ZOUT3. This means the power division at point B will be 50% to ZOUT3 and 50% into Z4. At the other end of Z4, the connection is made to OUT4. This network provides equal amplitude at each of the output ports and provides the desired phase progression because each of the transmission lines is 90 degrees long. [REVISE]

Assuming that all of the outputs will be terminated with the same impedance, Zout, and all transmission lines are 90° long, the following formulas can be used to determine the unknown impedances Z1 through Zn:

$$Z(n)=Zout/1 \quad (8)$$

$$Z(n-1)=Zout/2 \quad (9)$$

$$Z(n-2)=Zout/3 \quad (10)$$

$$Z(n-3)=Zout/4 \quad (11)$$

■

■

$$Z(1)=\sqrt{(Zout/n)\times(Zin)} \quad (12)$$

Figure 5:
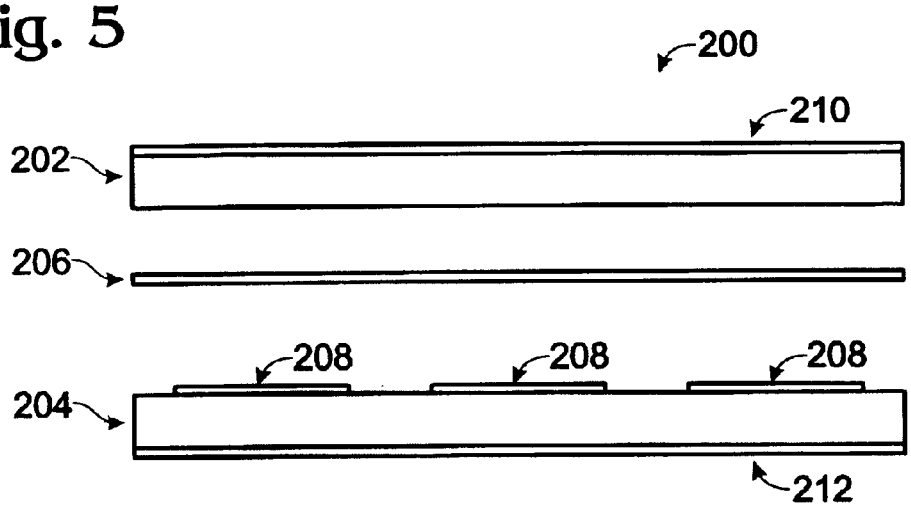
FIG. 5 is a vertical cross-sectional view of a surface-mountable device embodying the present invention.
Figure 6:
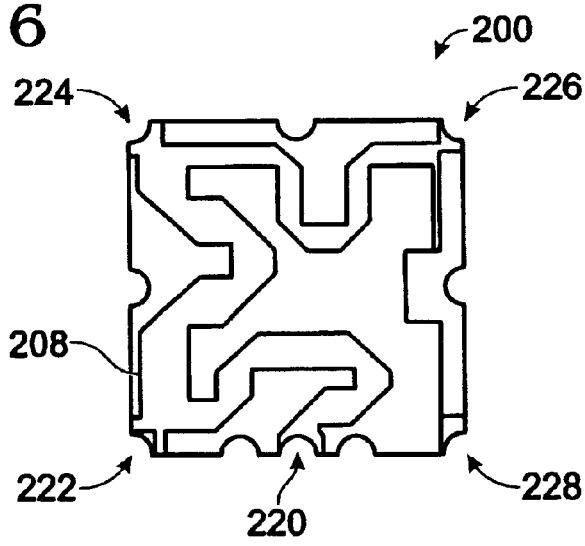
FIG. 6 is a horizontal cross-sectional view of a surface-mountable device embodying the present invention.

An example of a preferred embodiment is shown in FIG. 5 (vertical cross-sectional) and FIG. 6 (horizontal cross-sectional) wherein implementation of the circuit described above uses stripline technology. The circuit layout is preferably implemented in a surface mount package 200. The circuit is comprised of strips 208 of a conductive material, typically copper. The package 200 is made up of two sheets of dielectric material 202, 204 which are bonded together with a sheet of adhesive material 206. The outer sides of the dielectric materials 202, 204 are comprised of a metal ground plane 210, 212. The electrical and physical parameters of all the materials used must be considered when calculating the strip widths that are required for each of the impedances. In the surface mount package 200, connection is made to the internal strips 208 and to the ground planes 210 by way of plated through holes or vias that have been bisected with a saw which form the input port 220 and the output ports 222, 224, 226, 228 to the antenna.

Although the circuit has been described as implemented in a surface mount package, one skilled in the art would recognize that the circuit can also be manufactured and packaged in many other ways. These include but are not limited to "cased and connectorized" devices, microstrip assemblies, waveguide assemblies, coaxial cable assemblies and the like. Additionally, one skilled in the art would recognize that an assembly could be formed that incorporates the antenna and the feed network integrated together. This network could be printed directly on the material that houses the antenna.

What is claimed is:

1. A feed network comprising:

an input port for receiving or sending a first signal:

a first transmission line connected at one end to said input port;

a first connection point, said first connection point connected to another end of said first transmission line, said first connection point providing a path to a first output port;

plurality of additional transmission lines, connection points and output ports, serially connected such that each Nth transmission line is connected at one end to (N−1)th connection point;

each Nth connection point is connected to another end of the Nth transmission line, said Nth connection point providing a path to a Nth output part;

wherein said feed network provides equal amplitude at each of said output ports and further wherein said circuit provides 90° phase progression between each pair of adjacent output ports, wherein said feed network further comprises a package for mounting on the surface of an electronic circuit board, said package including at least two sheets of dielectric material, said sheets bonded together, each of said sheets including a metal ground plane on its unbonded surface.

2. The feed network of claim 1 wherein said input port, said transmission lines, said connection points, said paths and said output ports are placed between said sheets.

3. The feed network of claim 2 wherein said paths comprise copper stripline.

* * * * *